US005819347A

United States Patent [19]

Masuda

[11] Patent Number: 5,819,347

[45] Date of Patent: Oct. 13, 1998

[54] PILLOW COMPRISED OF BAGS FILLED WITH CEDAR CHIPS, POLYPROPYLENE PIPE CHIPS AND FIBERS CONTAINING AROMATIC ESSENCE OF JAPANESE CYPRESS

[75] Inventor: Toshiyuki Masuda, Chichibu, Japan

[73] Assignee: Masuda Co., Ltd., Saitama-Ken, Japan

[21] Appl. No.: 901,966

[22] Filed: Jul. 29, 1997

[30] Foreign Application Priority Data

Nov. 20, 1996 [JP] Japan ..... 8-011875 U

[51] Int. Cl.[6] ..... A47G 9/00

[52] U.S. Cl. ..... 5/641; 5/645; 5/948; 5/951

[58] Field of Search ..... 5/636, 641, 645, 5/951, 948

[56] References Cited

U.S. PATENT DOCUMENTS

| | | | |
|---|---|---|---|
| 69,376 | 10/1867 | Walton | 5/951 |
| 1,617,822 | 2/1927 | O'Leary | 5/641 |
| 3,148,389 | 9/1964 | Lustig | 5/645 |
| 3,216,028 | 11/1965 | Lawson | 5/639 |
| 4,756,035 | 7/1988 | Beier | 5/645 |
| 5,299,335 | 4/1994 | Ivester et al. | 5/641 |
| 5,522,105 | 6/1996 | Fujiwara et al. | 5/636 |
| 5,706,535 | 1/1998 | Takashima | 5/641 |
| 5,708,998 | 1/1998 | Torbik | 5/636 |

FOREIGN PATENT DOCUMENTS

| | | | |
|---|---|---|---|
| 403076815A | 4/1991 | Japan | 5/641 |
| 405161532A | 6/1993 | Japan | 5/641 |
| 999217 | 7/1965 | United Kingdom | 5/639 |

*Primary Examiner*—Alexander Grosz
*Attorney, Agent, or Firm*—Griffin, Butler, Whisenhunt & Szipl, LLP

[57] ABSTRACT

In a pillow comprising at least three substantially flat bags successively layered, each of intermediate layer bags other than top and bottom layer bags is provided with closure means and provided substantially at the middle of each intermediate layer bag with a pocket having also its own closure means through which cedar chips are enclosed in this pocket. Chips of synthetic resin are enclosed in one of the outermost layer bags and a fibrous member containing aromatic essence of Japanese cypress is enclosed in the other outermost layer bag. No content is enclosed in the bags other than the intermediate layer bags in their regions over- and underlying the pockets so that a recess having no significant thickness is formed in those regions over- and underlying the pockets. The regions of the intermediate layer bag(s) extending adjacent the periphery of the pillow may be loaded with cedar chip bags so as to adjust a thickness of the pillow in its peripheral region.

In this manner, the novel pillow supports the user's head and neck with comfortable stability and contributes to elimination of minute forms of life such as ticks as well as to a desired aroma-therapeutic effect.

6 Claims, 4 Drawing Sheets

PILLOW COMPRISED OF BAGS FILLED WITH CEDAR CHIPS, POLYPROPYLENE PIPE CHIPS AND FIBERS CONTAINING AROMATIC ESSENCE OF JAPANESE CYPRESS

FIELD OF THE INVENTION

The present invention relates to a pillow for use in connection with sleeping. This pillow provides an aroma-therapy effect as afforded by a forest-bath. While the pillow of the present invention is characterized by a relatively simplified construction, its design provides stable support for a user's head and neck.

BACKGROUND OF THE INVENTION

Pillows that comprise a plurality of substantially flat bags layered successively are well known. With such prior art pillows, polypropylene pipe chips are enclosed in one of the bags and polyester and/or cotton is enclosed in the other bag. Pillows of this type give a user a cool feeling owing to configuration as well as characteristics of the polypropylene pipe chips. However, it has been difficult for such prior art pillows to support the user's head and neck with comfortable stability due to an outer shape of the pillow as a whole. In addition, the contents enclosed in these prior art pillows have no effect to eliminate pests such as ticks.

In view of the problems unsolved by the prior art, it is a principal object of the invention to provide an improved pillow. The novel pillow is configured to support a user's head and neck with comfortable stability and acts to eliminate pests such as ticks. In addition, the novel pillow of the present invention has the same aroma-therapeutic effect as obtained by so-called forest bath.

SUMMARY OF THE INVENTION

The object set forth above is achieved, according to the invention, by a pillow comprising at least three substantially flat bags successively layered, said pillow being characterized in that intermediate layer bags other than top and bottom layer bags are provided with closure means and said intermediate layer bags are provided substantially at the middle thereof with pockets having also closure means through which cedar chips are enclosed in said pockets. Configurationally, the pocket or pockets contribute to said comfortably stabilized support of a users head and neck. The cedar chips enclosed therein contribute to the elimination of pests such as ticks and to an aroma-therapeutic effect.

When three bags are successively layered to provide an inner bag flanked by two outermost bags, chips of synthetic resin may be enclosed in one of the outermost bags and a fibrous member containing essence of Japanese cypress may be enclosed in the other outermost bag. The fibrous member enclosed in the one outermost bag provides the effect of eliminating pests such as ticks as well as providing an aroma-therapeutic effect. The chips of synthetic resin enclosed in the other outermost layer bag gives a user a comfortably cool feeling. Polypropylene pipe chips are suitable as said synthetic resin chips and polyester and/or cotton is suitable as said fibrous member.

Of the plural bags successively layered, the bags other than the intermediate layer bags have no content in their regions over- and underlying the pockets. As a result, a recess having no significant thickness is formed in said regions over- and underlying the pockets. This recess serves to stabilize and support the back of a user's head. The intermediate layer bags may be loaded with cedar chip bags to adjust a thickness of the pillow along its peripheral region. The thickness of the pillow along its peripheral region serves to support a user's neck.

The closure mean associated with the intermediate layer bags are provided along a peripheral region of the pillow. The closure means associated with the pockets are provided adjacent the closure means associated with the intermediate layer bags. Such arrangement facilitates both the closure means associated with these components to be operated more easily.

It is possible to provide the closure means associated with the intermediate layer bags along a short side edge of the pillow. Such arrangement is effective to avoid allowing a user's head and neck to come into uncomfortable contact with the closure means.

The cedar chips to be loaded into the pockets may be preloaded into openable bags which are separately provided. This allows these bags to be washed and the cedar chips to be reactivated.

Figure 1:
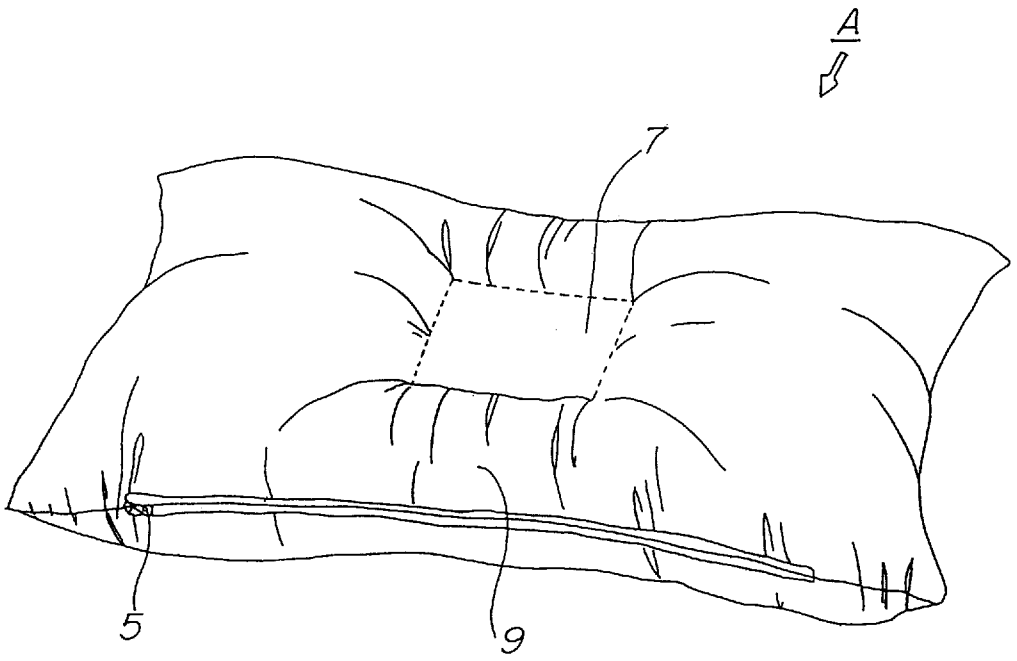
FIG. 1 is a perspective view showing a pillow according to the invention.

Reference alphanumerics used in the drawing numerals designate respective components as follows: A designates a pillow, a, b, and c designate top layer bag, intermediate layer bag and bottom layer bag, respectively; 1, 2, 3, and 4 designate left, right, rear, and front sides of a periphery, respectively; 6 designates a pocket; 7 designates a recess; 9 designates a peripheral region; 10 and 11 designate cedar chip bags; and 5, 8, and 12 designate closure means associated with the intermediate layer bag, the pocket, and each of the cedar chip bags, respectively.

DESCRIPTION OF PREFERRED EMBODIMENTS

Details of the invention will be more fully understood from the following description of an embodiment hereinunder given with reference to the accompanying drawings. It should be understood that many modifications as well as variations of the specific embodiments described below will be apparent to those skilled in the art without departing from the spirit and scope of the invention.

Figure 2:
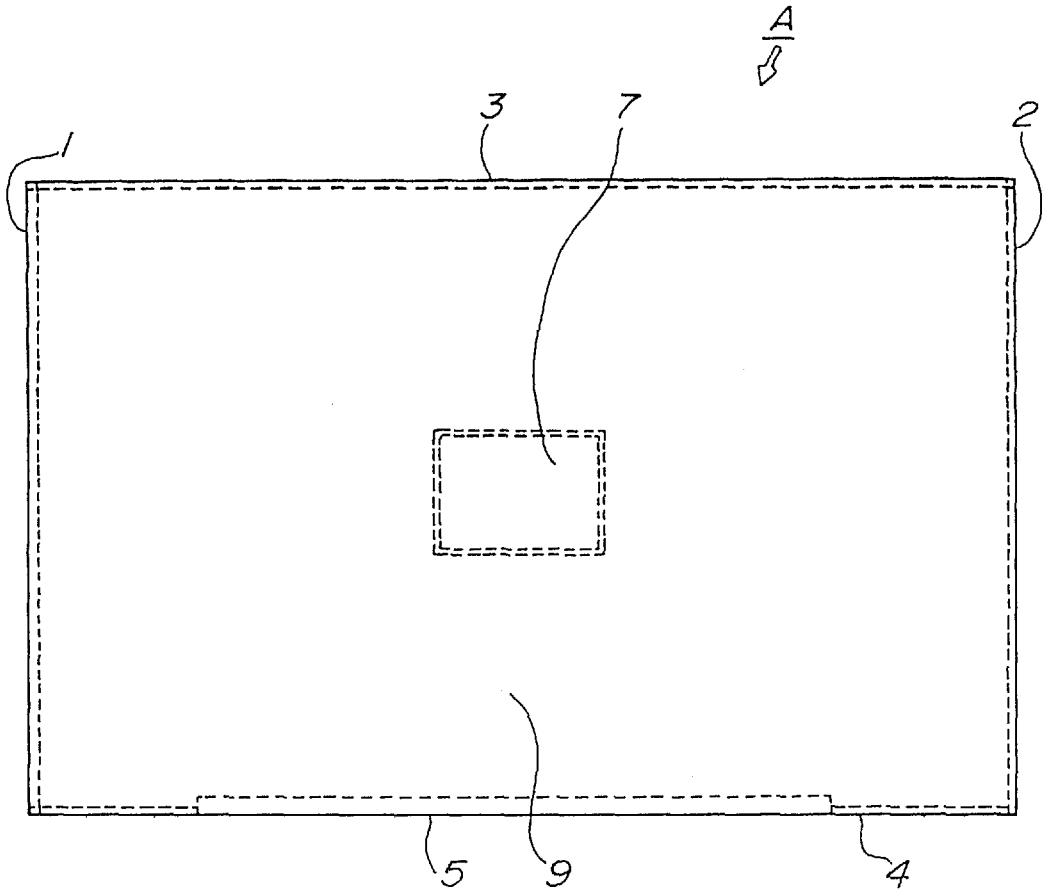
FIG. 2 is a plan view showing the pillow.
Figure 3:
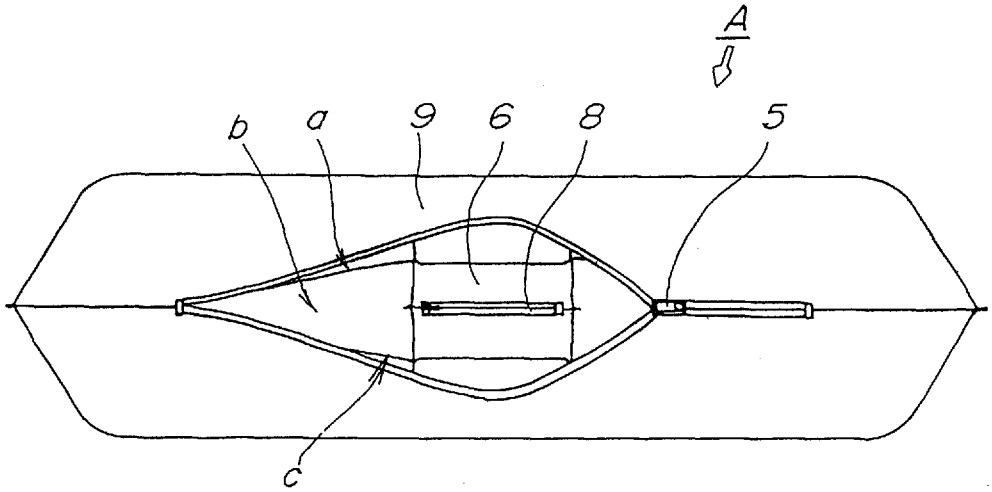
FIG. 3 is a front view showing the pillow with its closure means being opened.

FIGS. 1 and 2 show a pillow (A) of the invention in perspective and plan views, respectively. FIG. 3 shows the pillow (A) with closure means (5) provided along a side (4) of the periphery of the pillow (A) being opened. The closure means (5) thus opened reveals a pocket (6) of an intermediate layer bag (b).

The pillow (A) has a rather flat outer shape defined by a rectangle approximately of 40 cm×60 cm containing therein a three-layered structure. Specifically, the structure comprises three substantially flat bags (a), (b), and (c). Of these three bags (a), (b), and (c) layered one upon another, the intermediate layer bag (b) is provided substantially at its middle with a pocket (6).

The pocket (6) is preferably dimensioned to have a short side of about 8 cm, a long side of about 10 cm, and a thickness of about 6 cm. The pocket (6) is provided adjacent the closure means (5) for the intermediate layer bag (b) with closure means (8). The closure means (8) may be opened to load the pocket (6) with a desired quantity of cedar chips. Typically, said cedar chips are made of eastern red cedar growing in the Appalachian Ozarks region.

Figure 4:
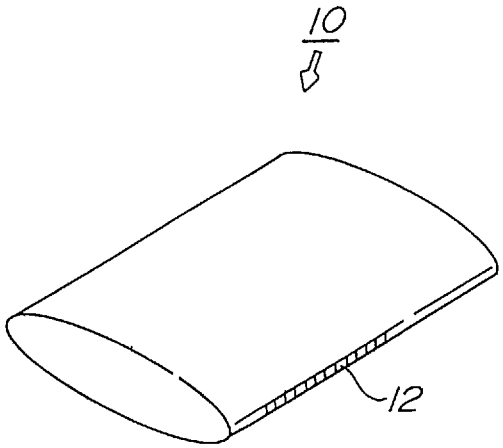
FIG. 4 is a perspective view showing a cedar chip bag to be loaded into a pocket.

As shown by FIG. 4 in a perspective view, the cedar chips are preloaded into a bag (10) which is substantially planar and slightly smaller than the pocket (6). This cedar chip bag (10) is also provided with closure means (12). The closure means (12) is operated when the bag (10) is emptied of the cedar chips in order to wash and reactivate the cedar chips or to launder the bag itself. No sealing function is required for these closure means (5), (8), and (12) and they may be of any types which have conventionally been used, so far as they function to prevent the contents from leaking. For example, fastener, Magic Tape, buttons, and drawstring made of cloth may be selectively employed. The closure means (5) and (8) are shown as being provided adjacent the front side (4) of the periphery. However, it is preferred to provide them adjacent the left and right sides (1) and (2) of the periphery to avoid the closure means (5) and (8) from uncomfortably contacting a user's head.

The top layer bag (a) encloses chips of synthetic resin such as pieces of polypropylene pipe serving to give the user a comfortably cool feeling. The bottom layer bag (c) encloses a fibrous member such as polyester and/or cotton containing aromatic essence of Japanese cypress. More specifically, the fibrous member comprises individual fibers impregnated with essential oil of Japanese cypress into their cores. In this manner, the fibrous member diffuses aromatic substance such as terpene little by little for a long period. It should be understood that the contents of both the top and bottom layer bags (a) and (c) are exchangeable.

Regions of said top and bottom layer bags (a) and (c) over- and underlying the pocket (6), respectively, have substantially no content. Consequently, said regions of the top and bottom layer bags (a) and (c) over- and underlying the pocket (6) define a recess (7) having no significant thickness.

Figure 5:
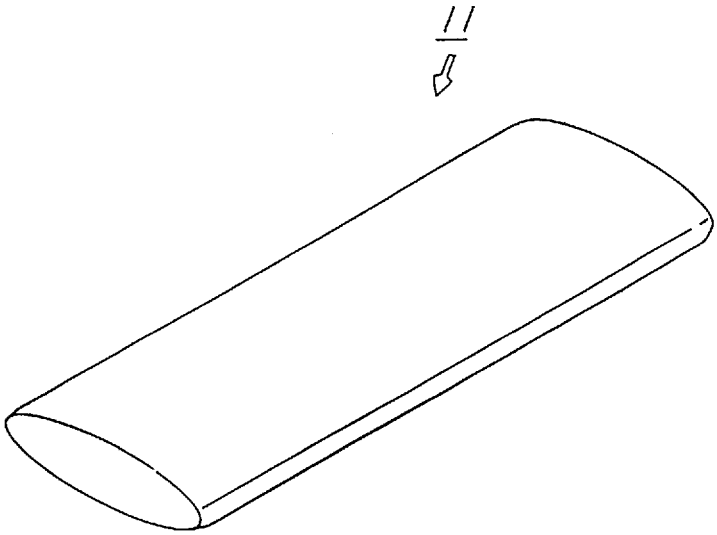
FIG. 5 is a view similar to FIG. 4, showing one of cedar chip bags to be loaded into associated one of the peripheral regions.
Figure 6:
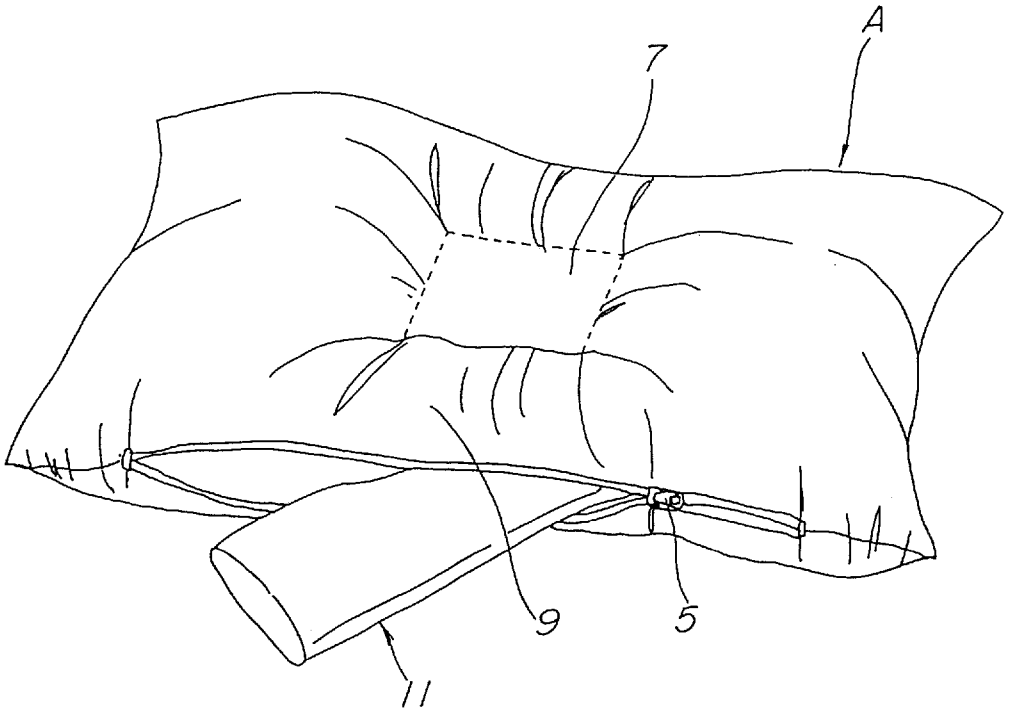
FIG. 6 is a perspective view showing the pillow as said cedar chip bag being loaded into the peripheral region.

FIG. 5 is a perspective view showing a cedar chip bag (11) to be loaded into the pillow (A) along each peripheral region (9). FIG. 6 is a perspective view showing this cedar chip bag (11) being loaded into the pillow (A) through the closure means (5) which has been opened for this purpose. The cedar chip bag (11) presents a rather flat rectangular shape defined by a short side slightly smaller than a distance between the closure means (5) and the pocket (6) and a long side slightly smaller than the long side of the pillow (A). This cedar chip bag (11) may be loaded into the pillow (A) so as to occupy the peripheral region (9) and thereby to adjust a thickness (i.e., a height) of the pillow (A).

The peripheral region (9) supports a user's neck. A thickness, a width, and a hardness of the peripheral region (9) may be adjusted by appropriately selecting the thickness or the number of the cedar chip bags (11). It should be noted that the cedar chip bags (10) and (11) comprise a combination of paper and fiber such as nylon and are not full of the cedar chips. Such arrangement eliminates an uncomfortable feeling for a user's head.

With the construction as has been described above, the pillow (A) presents a unique configuration defined by the recess (7) and the peripheral region (9) contiguous to said recess (7). The recess (7) adapted to support a user's head and the peripheral region (9) adapted to support his or her neck with stability and comfort. Characteristics such as shapes and hardness of said recess (7), pocket (6) and peripheral region (9) are preferably selected depending on the form of the particular user. Such selection should be made on the basis of so-called human engineering.

Comfortable and stable support of both the head and the neck ensure sweet sleep and alleviate the eventuality of snoring.

The pillow (A) is provided either in the top layer bag (a) or the bottom layer bag (c) with a fibrous member containing aromatic essence of Japanese cypress. In addition, the pocket (6) is also loaded with the cedar chips. Such novel construction is effective to suppress various pests such as ticks (which contribute to atopic and asthmatic diseases). Furthermore, the pillow of the invention provides the effect of aroma-therapy with its rather simplified construction. In this manner, the pillow of the invention allows a user to enjoy sweet sleep in a relaxing mood of forest-bath. The pillow of the invention provides also a physiological effect of recovery from fatigue and stabilization of the circulatory system.

What is claimed is:

1. A pillow (A) comprising at least three substantially flat bags successively layered to provide at least a top layer bag (a), an intermediate layer bag (b), and a bottom layer bag (c), wherein:

each intermediate layer bag (b) is provided with closure means (5);

each intermediate layer bag (b) is provided substantially at the middle thereof with a pocket (6) having closure means (8) through which cedar chips are enclosed in said pocket (6);

the closure means (5) associated with said intermediate layer bag(s) (b) extend along the peripheral region (9) of the pillow (A) and the closure means (8) associated with the pocket(s) (6) are provided adjacent said closure means (5) associated with the intermediate layer bag(s) (b); and said top and bottom layer bags (a) and (c) each have no filling in their regions respectively overlying and underlying said pocket(s) (6).

2. The pillow of claim 1, comprising three bags (a), (b and (c) layered one upon another, wherein chips of synthetic resin are enclosed in one of the top or bottom layer bags (a) or (c) and a fibrous filler containing aromatic essence of Japanese cypress is enclosed in the other top or bottom layer bag (a) or (c).

3. The pillow of claim 2, wherein said chips of synthetic resin comprise polypropylene pipe chips and said fibrous filler comprises a member selected from the group consisting of polyester and cotton.

4. The pillow of claim 1, wherein cedar chips are introduced into the intermediate layer bag(s) (b) through the closure means (5) of said intermediate layer bag(s) (b) so as to adjust a thickness of the pillow (A) in its peripheral region (9).

5. The pillow of claim 1, wherein the closure means (5) associated with the intermediate layer bag(s) (b) are provided along one short side (1, 2) of the pillow's periphery (9) so as to avoid contact of said closure means (5) with a user's head and neck.

6. The pillow of claim 1, wherein the cedar chips to be loaded into the pockets are enclosed in openable bags (10, 11) associated with the respective pockets (6) when a plurality of pocket are provided.

* * * * *